US008371468B2

(12) United States Patent
Sellari et al.

(10) Patent No.: US 8,371,468 B2
(45) Date of Patent: Feb. 12, 2013

(54) TAMPER EVIDENT CONTAINERS

(75) Inventors: Robert Sellari, Huntington, CT (US); Peter Boback, Stratford, CT (US); Tadeusz J. Klimaszewski, Hamden, CT (US); Bruce Stein, Easton, CT (US)

(73) Assignee: Inline Plastics Corp., Shelton, CT (US)

( * ) Notice: Subject to any disclaimer, the term of this patent is extended or adjusted under 35 U.S.C. 154(b) by 576 days.

(21) Appl. No.: 12/583,223

(22) Filed: Aug. 17, 2009

(65) Prior Publication Data

US 2011/0036842 A1 Feb. 17, 2011

(51) Int. Cl.
*B65D 45/00* (2006.01)

(52) U.S. Cl. ..... 220/315; 220/4.21; 220/4.22; 220/4.23; 220/4.24; 220/260; 220/265; 220/810; 206/807

(58) Field of Classification Search ..... 220/260, 220/265, 315, 810, 4.21, 4.22, 4.23, 4.24; 206/807

See application file for complete search history.

(56) References Cited

U.S. PATENT DOCUMENTS

| | | | |
|---|---|---|---|
| 3,616,487 | A | 11/1971 | Dearth |
| 3,710,761 | A | 1/1973 | Gregory |
| 4,048,051 | A | 9/1977 | Gretz |
| 4,298,133 | A | 11/1981 | Davis |
| 4,460,091 | A | 7/1984 | Hain et al. |
| 4,576,307 | A | 3/1986 | Frydenberg |
| 4,687,117 | A | 8/1987 | Terauds |
| 4,717,024 | A | 1/1988 | Djezovic |
| 4,744,487 | A | 5/1988 | Welborn |
| 4,782,977 | A | 11/1988 | Watanabe et al. |
| 4,792,055 | A | 12/1988 | Schupack et al. |
| 5,007,143 | A | 4/1991 | Herrington |
| 5,193,706 | A | 3/1993 | Hanna et al. |
| 5,219,087 | A | 6/1993 | Christensson |
| 5,421,473 | A | 6/1995 | McCrossen |
| 5,709,308 | A | 1/1998 | Gics |
| 5,865,307 | A | 2/1999 | Friedman |
| 5,867,875 | A | 2/1999 | Beck et al. |
| 5,919,535 | A | 7/1999 | Dobreski et al. |
| 5,931,291 | A | 8/1999 | Sedon et al. |
| 5,964,368 | A | 10/1999 | Schramm |
| 5,979,690 | A | 11/1999 | Hartley |
| 6,092,687 | A | 7/2000 | Hupp et al. |

(Continued)

FOREIGN PATENT DOCUMENTS

| | | | |
|---|---|---|---|
| EP | 0665170 | A1 | 8/1995 |
| WO | WO-9828995 | A1 | 7/1998 |

*Primary Examiner* — Anthony Stashick
*Assistant Examiner* — Elizabeth Volz
(74) *Attorney, Agent, or Firm* — Edwards Wildman Palmer LLP; Barry Kramer; David J. Silvia

(57) ABSTRACT

A product storage container that includes a container body, a slide mechanism, and a frangible tear strip. The container body includes a base portion that is joined to a cover portion through a hinge section. The cover portion provides an upper flange extension that defines a first slot, the base portion provides a lower flange extension that defines a second slot, and the hinge section allows the cover portion to move between an open position and a closed position. The slide mechanism is positioned within the first and second slots and is configured to secure the cover portion in the closed position when arranged in a first position. The frangible tear strip maintains the slide mechanism in the first position, and upon severing, allows the slide mechanism to travel to a second position which enables the cover to be moved to the open position.

20 Claims, 8 Drawing Sheets

U.S. PATENT DOCUMENTS

| | | | | |
|---|---|---|---|---|
| 6,325,239 | B2 | 12/2001 | Randall et al. | |
| 6,394,299 | B1 | 5/2002 | Hupp | |
| 6,405,864 | B1 | 6/2002 | Streich et al. | |
| 6,592,000 | B1 | 7/2003 | Owens et al. | |
| 6,644,494 | B2 | 11/2003 | Hayes et al. | |
| 6,722,520 | B2 | 4/2004 | Hupp et al. | |
| 6,755,302 | B1 * | 6/2004 | Streich et al. | 206/373 |
| 6,761,283 | B1 | 7/2004 | Gilliam et al. | |
| D497,548 | S | 10/2004 | Nordland | |
| 6,880,717 | B1 | 4/2005 | O'Conor | |
| 7,017,776 | B1 | 3/2006 | Hupp | |
| 7,090,089 | B2 | 8/2006 | Lown et al. | |
| 7,124,910 | B2 | 10/2006 | Nordland | |
| 2002/0033396 | A1 | 3/2002 | Hupp et al. | |
| 2003/0015534 | A1 | 1/2003 | Lown et al. | |
| 2003/0098308 | A1 | 5/2003 | Cerone et al. | |
| 2005/0161455 | A1 * | 7/2005 | Studee | 220/266 |
| 2006/0289549 | A1 | 12/2006 | Vovan | |
| 2007/0007163 | A1 | 1/2007 | Schlattl et al. | |
| 2007/0045317 | A1 | 3/2007 | Rosender et al. | |
| 2007/0138180 | A1 | 6/2007 | Vovan | |

* cited by examiner

TAMPER EVIDENT CONTAINERS

BACKGROUND OF THE INVENTION

1. Field of the Invention

The present invention is directed to containers and packaging for a variety of consumer products, and more particularly, to tamper evident containers and packages that include a container body and at least one slider mechanism for securing the container body in a closed position.

2. Background of the Related Art

Disposable containers for packaging, distributing, displaying or otherwise housing consumer items, especially perishable foods, are becoming increasingly important. Historically, perishable products had to be brought to market and sold quickly before exposure to the atmosphere caused the products to lose their freshness.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store the products for longer periods of time, resulting in substantial savings.

It has been found that consumers like recloseable packages, particularly for comestible products, especially in circumstances where more than one serving of a comestible product is contained therein, in order to reduce drying out or other deterioration of the comestible food product. In addition, in certain circumstances consumers prefer to visually inspect the food product within such containers prior to purchase. Thus, fabricating containers from clear see-through plastics is desirable. For example, packaging provided for bakery goods has often been in the form of clear, plastic clamshell packaging, because, among other things, such clear, plastic clamshell packaging provides a baked-on-the-premises image which grocery retailers have found to be especially appealing to consumers.

Typically, plastic containers will include a fairly rigid lid/cover and base, although they may be subject to some amount of flexure. The lid provided must be capable of properly and effectively sealing the container, yet the container must be constructed so that the lid is relatively easy to remove, and even replace, since it is expected that the container and lid would normally be reused.

In addition to the aforementioned consumer design preferences, it is desirable to fabricate containers that include features which either deter unauthorized tampering or clearly indicate whether unauthorized tampering has occurred, or both. These tamper-resistant/evident features typically include structural elements which, when the container is tampered with or opened without authorization, enable the consumer to easily visually recognize such tampering so that the product can then be rejected. Such tamper-resistant/evident elements are important for, among other things, deterring theft and preventing the loss of product and income for the seller, as well as instilling consumer confidence in the integrity of the contents within the container and confidence in the ability of the seller and/or manufacturer to provide and maintain quality goods.

Thus, there is a compelling interest in the development of containers having consumer-preferable design elements, such as recloseability features which are reliable and easy to operate, along with tamper-resistant/evident features that deter tampering and clearly indicate whether tampering has occurred, and which are also reliable without being burdensome to the legitimate consumer. Accordingly, the present invention is directed to containers that meets these needs.

SUMMARY OF THE INVENTION

The present invention meets the aforementioned needs, while also improving upon and solving problems associated with previous containers by providing a product container that includes, inter alia, a container body that has a base portion which is joined to a cover portion through a hinge section. The cover portion provides an upper flange extension that defines a first slot and the base portion provides a lower flange extension that defines a second slot.

The hinge section allows the cover portion to move between an open position wherein the cover portion is spaced apart from the base portion to a closed position wherein the cover portion is approximated with the base portion and forms a product storage compartment.

Preferably, the cover portion and the base portion are adapted and configured to sealingly engage about their periphery. Those skilled in the art will readily appreciate that a variety of known perimeter seal constructions can be used to prevent the contents of the container from escaping or leaking from the product storage compartment.

The container further includes a slide mechanism that is positioned within the first and second slots and is configured to secure the cover portion in the closed position when the slide mechanism is arranged in a first position. In certain constructions, the slide mechanism includes a lower body portion, an upper body portion, a lanyard extending between the upper and lower body portions and structure associated with the upper and lower body portions for securing the slide mechanism in an assembled configuration.

In a preferred embodiment, the structure for securing the slide mechanism in an assembled configuration includes at least one prong member associated with the lower body portion of the slide mechanism and a keeper element associated with the upper body portion of the slide mechanism. Those skilled in the art will readily appreciate that the prong member could be associated with the upper body portion of the slide mechanism and the keeper member associated with the lower body portion. Moreover, other types of latching or securing structure can be used for securing the slide mechanism in an assembled configuration. Preferably, once placed in the assembled configuration, the slide mechanism can not be disassembled or separated from engagement with the container body without destroying either the container body of the slide mechanism.

The container further includes a frangible tear strip associated with one of the upper or the lower flange extensions, which maintains the slide mechanism in the first position and upon severing allows the slide mechanism to travel to a second position thereby enabling the cover to be moved to the open position. In certain constructions, the second slot which is defined in the lower flange section of the base portion is longer than the first slot that defined in the upper flange section. In such a construction, it is preferred that the frangible tear strip is associated with the upper flange section.

Those skilled in the art will readily appreciate that more than one slide mechanism, with or without corresponding tamper-evidence features (e.g., a tear strip), can be used to secure the container in the closed position. More specifically, the container may include a tamper-evident mechanism or feature for each slide mechanism.

It is envisioned that in certain embodiments of the present invention, the hinge section is adapted and configured to bias the container in the open position such that when the slide mechanism is moved to the second position the container springs open.

Preferably, the cover portion and the base portion have a generally rectangular configuration. However, those skilled in the art will readily appreciate that the inventive aspects of the present invention are not limited to rectangular containers and can be applied to containers of various shapes.

The present invention is also directed to a product storage container that includes, inter alia, a container body having a base portion and a cover portion. The cover portion provides an upper flange extension that defines a first elongated slot and the base portion provides a lower flange extension that defines a second elongated slot. The first and second elongated slots are aligned when the cover portion is approximate the base portion and forming a product storage compartment.

A slide mechanism is positioned within the first and second slots of the upper and lower flange extensions. The slide mechanism is configured to secure the cover portion in the closed position when the slide mechanism is arranged in a first position.

A frangible tear strip is associated with one of the upper or the lower flange extensions, which maintains the slide mechanism in the first position and upon severing allows the slide mechanism to travel to a second position thereby enabling the cover to be moved to the open position.

In a preferred embodiment, the product storage container includes a hinge section that joins the cover portion to the base portion and allows the cover portion to move between an open position, wherein the cover portion is spaced apart from the base portion, to the closed position. It is envisioned that in certain constructions of the inventive container, the hinge section is adapted and configured to bias the container in the open position such that when the slide mechanism is moved to the second position the container springs open.

In certain constructions of the present invention, the cover portion and the base portion of the container body are adapted and configured to sealingly engage about their periphery.

The present invention is further directed to a tamper-evident/resistant product storage container that includes, inter alia, a container body formed by a base portion that is joined to a cover portion through a hinge section. The cover portion provides an upper flange extension that defines a cutout. The base portion provides a lower flange extension. The hinge section allows the cover portion to move between an open position wherein the cover portion is spaced apart from the base portion to a closed position wherein the cover portion is approximated with the base portion and forms a product storage compartment.

A slide mechanism is movable between a first position and a second position. In the first position the slide mechanism is engaged with the upper and lower flange extensions and secures the cover portion in the closed position. In the second position, the slide mechanism is aligned with the cutout in the upper flange thereby enabling the cover to be moved to the open position.

The container further includes a mechanism for indicating whether the slide mechanism has been previously moved from the first position to the second position. In certain embodiments, the mechanism for indicating whether the slide mechanism has been previously moved from the first position to the second position includes at least one molded protuberance formed in the upper flange extension of the cover portion. In certain constructions, the mechanism for indicating whether the slide mechanism has been previously moved from the first position to the second position includes two molded protuberance formed in the upper flange extension of the cover portion.

The present invention is also directed to a tamper-evident/resistant product storage container that includes, among other elements, a container body having a base portion that is joined to a cover portion through a hinge section. The cover portion provides an upper peripheral flange extension that includes at least one frangible section that upon removal defines a cutout. The base portion provides a lower peripheral flange extension. The hinge section allows the cover portion to move between an open position wherein the cover portion is spaced apart from the base portion to a closed position wherein the cover portion is approximated with the base portion and forms a product storage compartment.

The container further includes at least one slide mechanism that is movable between a first position and a second position. In the first position the slide mechanism is engaged with the upper and lower flange extensions and secures the cover portion in the closed position. In the second position the slide mechanism is aligned with the cutout in the upper flange thereby enabling the cover to be moved to the open position.

Preferably, the tamper-evident/resistant product storage container further includes a mechanism for indicating whether the at least one slide mechanism has been previously moved from the first position to the second position. In certain constructions, this mechanism can include at least one molded protuberance formed in the upper flange extension of the cover portion.

In certain constructions, the container is made from a polymeric material. It is envisioned that the polymeric material can be chosen from the group consisting of polyethylene, polypropylene, polyvinyl chloride, polyethylene terephtalate and combinations thereof. However other currently existing or newly created polymers or synthetic materials can be used, such as polylactic acid based polymers which include impact modifiers.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the subject invention pertains will more readily understand how to make and use the tamper-resistant/evident container disclosed herein, embodiments thereof will be described in detail below with reference to the drawings, wherein.

DETAILED DESCRIPTION OF PREFERRED EMBODIMENTS

Figure 1:
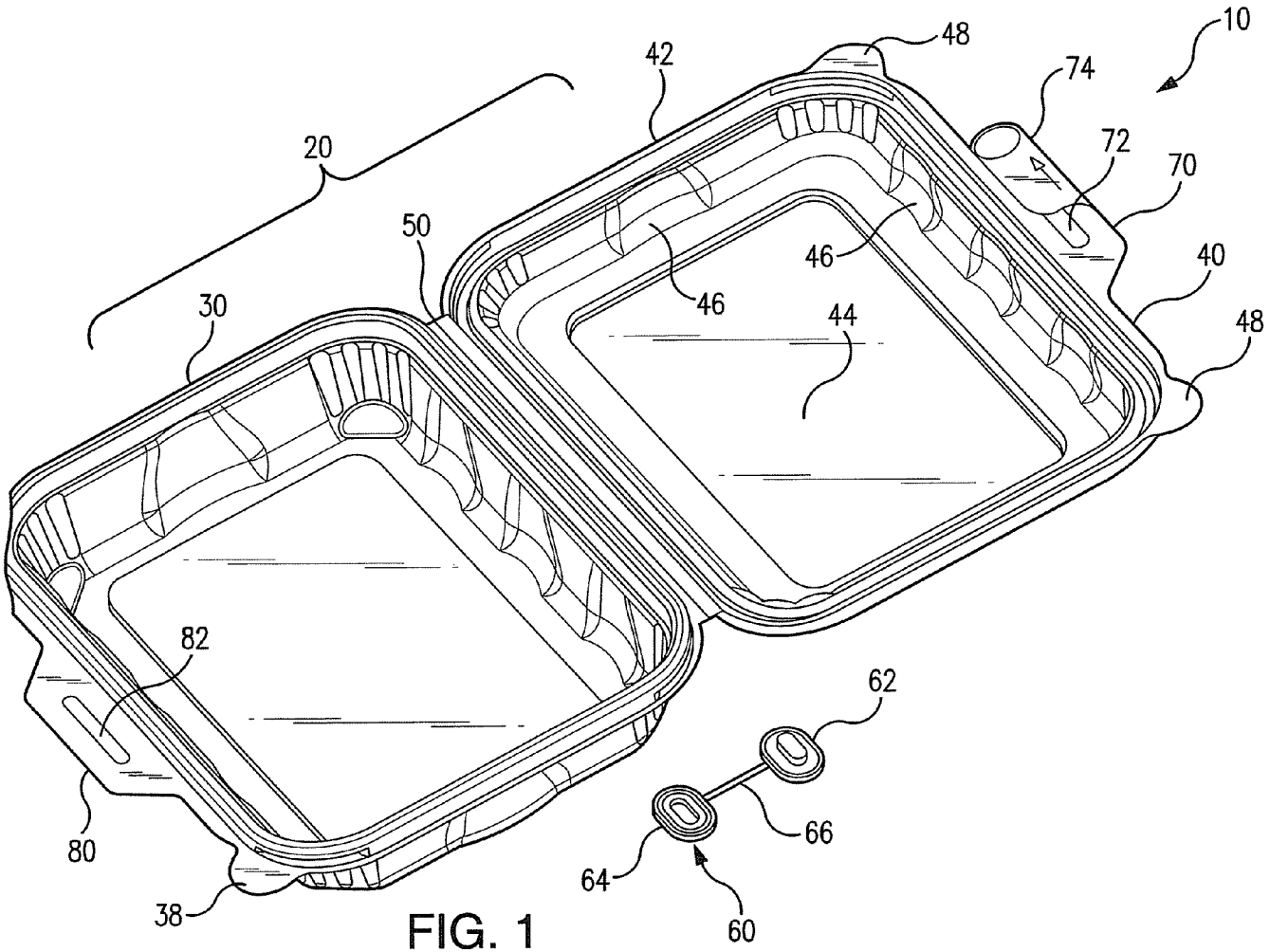
FIG. 1 is an exploded perspective view of a tamper-resistant/evident container constructed in accordance with the present invention which includes a container body and a slider mechanism.

The advantages of a tamper-resistant/evident container constructed in accordance with the present invention will become more readily apparent to those having ordinary skill in the art from the following detailed description of certain preferred and exemplary embodiments taken in conjunction with the drawings which set forth representative embodiments thereof, but are not intended to limit the scope of the present invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

Referring now to the drawings, there is illustrated in FIG. 1 an exploded view of a tamper-resistant product container which has been construction in accordance with a preferred embodiment of the present invention and designated as reference numeral 10. Product container 10 includes a container body 20 that has a base portion 30 which is joined to a cover portion 40 through a hinge section 50.

The cover portion 40 is formed in-part from a planar top 44 that has stiffened lateral side walls 46 extending from its periphery. The lateral side walls 46 terminate in an outer peripheral flange 42. Two grasping tabs 48 extend from the outer peripheral flange 42 and provide a structure which can be used to open container 10. The outer peripheral flange 42 also includes a horizontally arranged upper flange extension 70. As will be discussed in detailed below, a slot 72 is formed in the upper flange extension 70 and is used to secure the container in the closed position.

The base portion 30 of the container is formed in-part from a planar bottom 34 that has stiffened lateral side walls 36 extending upwardly from its periphery. The lateral side walls 36 terminate at an outer peripheral flange 32. Two grasping tabs 38 and a lower flange extension 80 project horizontally from the outer peripheral flange of the based portion. A slot 82 is formed in the in the lower flange extension 80.

Those skilled in the art will readily appreciate that the container can be provided without grasping tabs 38 and 48 without departing from the scope of the present invention.

Figure 2:
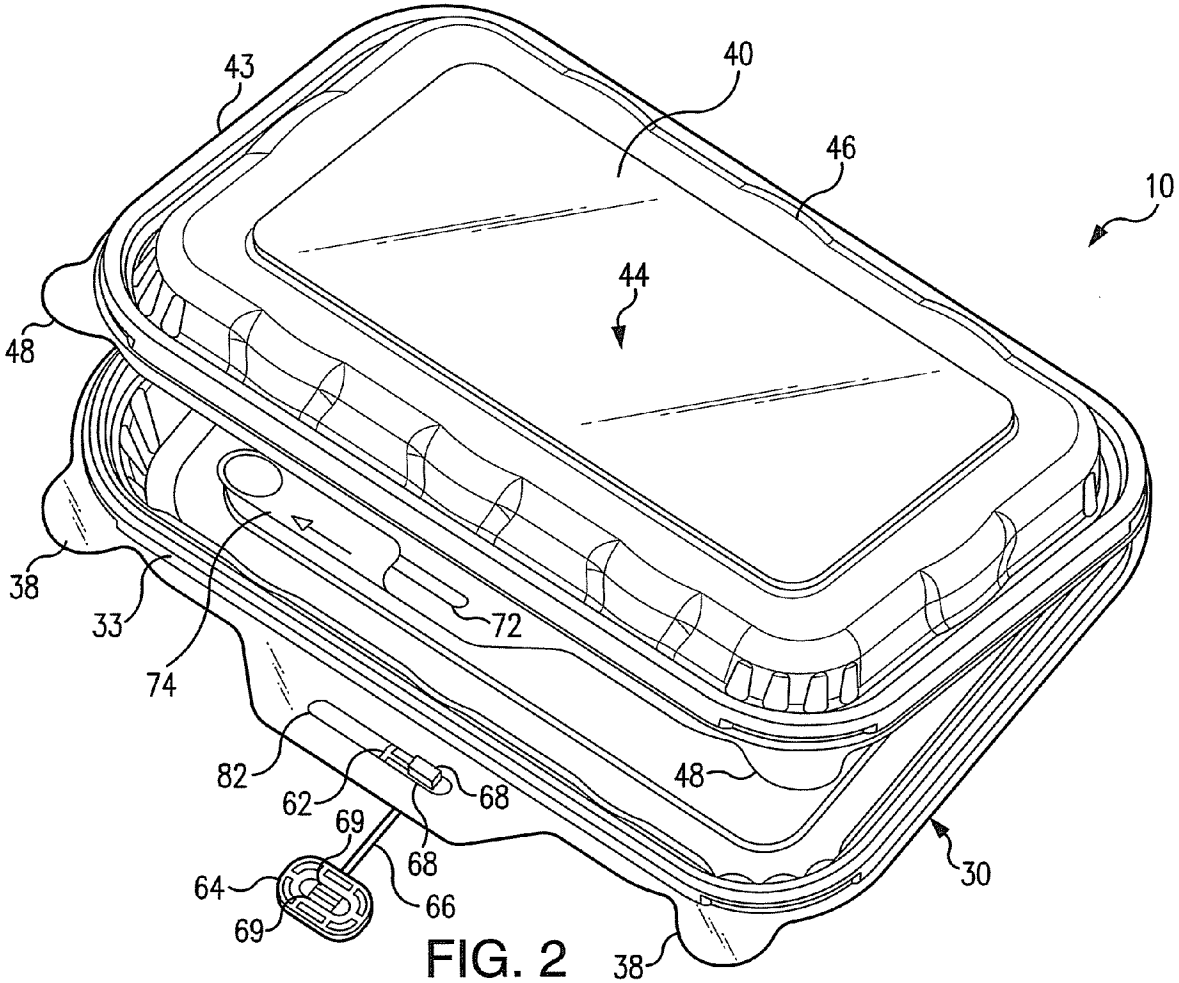
FIG. 2 is a perspective view of the tamper-resistant/evident container of FIG. 1 wherein the container body includes a base portion and cover portion connected to each other by a hinge and the slider mechanism is partially inserted into a slot formed in the locking flange of the base portion.

The cover portion 40 and the base portion 30 are adapted and configured to sealingly engage about their periphery. As shown in FIG. 2 the outer peripheral flange 32 of the base portion 30 includes an upwardly projecting convex surface 33 which is adapted for interlocking engagement with a corresponding concave recess 43 formed in the outer peripheral flange 42 of the cover portion 40. Those skilled in the art will readily appreciate that a variety of known perimeter seal constructions can be used to prevent the contents of the container from escaping or leaking from the product storage compartment.

Figure 3:
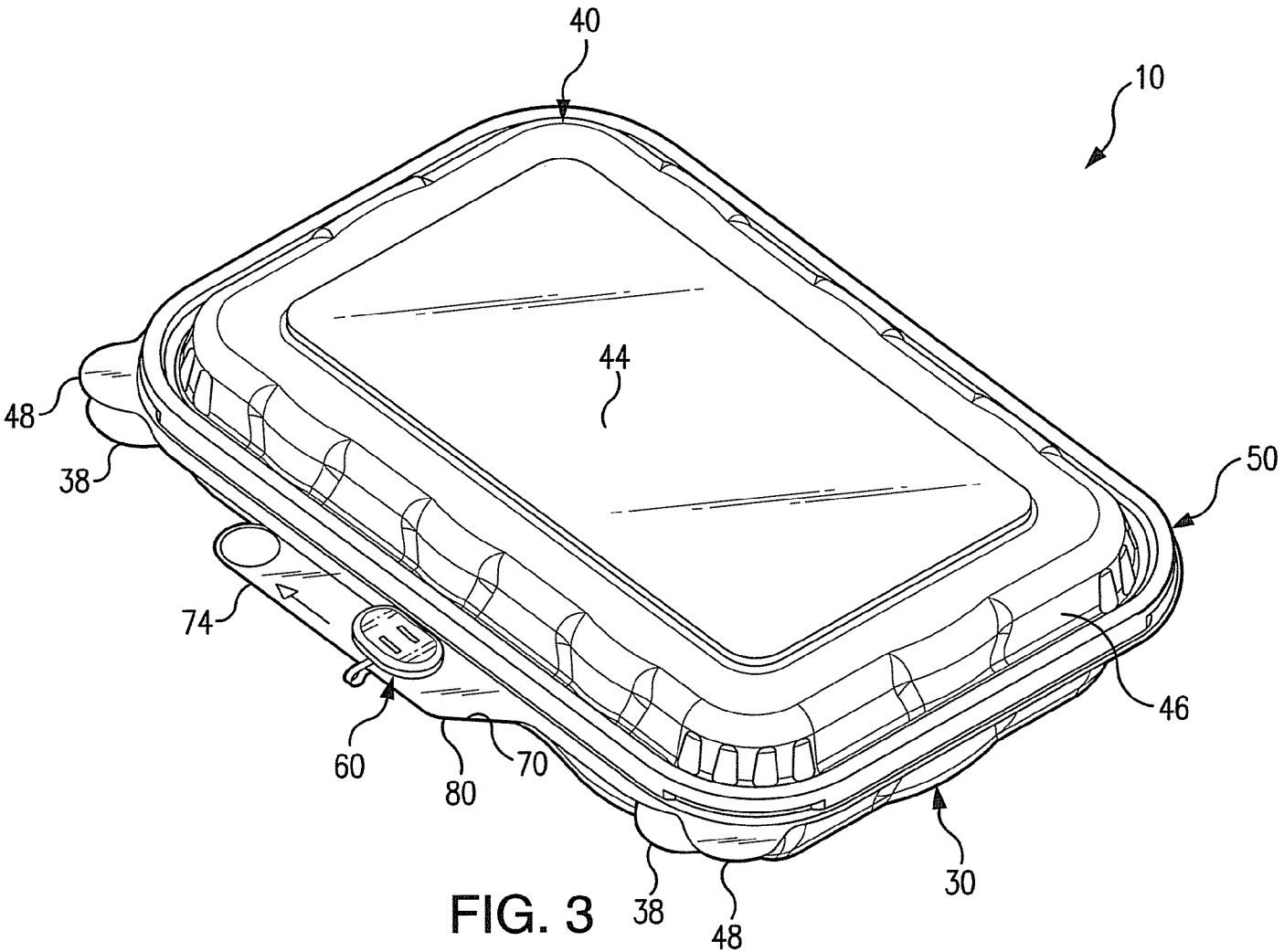
FIG. 3 is a perspective view of the tamper-resistant/evident container of FIG. 1 in the locked configuration wherein the slider mechanism is assembled and fully engaged within the slots formed in the locking flanges of the base portion and the cover portion of the container body.

The hinge section 50 allows the cover portion 40 to move between an open position wherein the cover portion 40 is spaced apart from the base portion 30 (FIG. 1) to a closed position wherein the cover portion 40 is approximated with the base portion 30 and forms a product storage compartment (e.g., FIG. 3).

The container 10 further includes a slide mechanism 60 that has lower body portion 62, an upper body portion 64, and a lanyard 66 extending between the upper and lower body portions 62/64. As will be discuss hereinbelow, when assembled the slide mechanism is positioned within slots 62/72 and is configured to secure the cover portion 40 in the closed position when the slide mechanism 60 is arranged in a first position.

As shown in FIG. 2, the structure which secures the slide mechanism 60 in an assembled configuration includes two prong members 68 associated with the lower body portion 62 of the slide mechanism 60 and two keeper elements 69 associated with the upper body portion 64 of the slide mechanism 60. When the upper body portion 64 of the slide mechanism 60 is aligned with the lower body portion 62 the prong members 68 can be pressed into locking engagement with the keeper members 69. Those skilled in the art will readily appreciate that the prong members could be associated with the upper body portion of the slide mechanism and the keeper member associated with the lower body portion. Moreover, other types of latching or securing structure can be used for securing the slide mechanism in an assembled configuration. Preferably, once placed in the assembled configuration, the slide mechanism 60 can not be disassembled or separated from engagement with the container body 20 without destroying either the container body 20 of the slide mechanism 60.

The container 10 further includes a frangible tear strip 74 associated with the upper flange extension 70. The use and operation of frangible tear strip 74 will be discussed in detail below.

As shown in FIG. 2, after being loaded with consumer product, the container 10 is assembled by inserting the prong members of the slide mechanism into the slots 72/82 formed in the upper and lower flange extensions 70/80 respectively. Then, the upper body portion 64 of the slide mechanism 60 is aligned with the lower body portion 62 while the container body 20 is held closed and the prong members 68 are pressed into locking engagement with the keeper members 69.

As shown in FIG. 1, slot 82 formed in the lower flange extension 80 is much longer than slot 72 formed in the upper flange extension 70. Therefore, in the assembled configuration as shown in FIG. 3, the slide mechanism can only traverse the length of slot 72 and the container 10 can not be opened. More specifically, frangible strip 74 maintains the slide mechanism 60 in the first position.

Figure 4:
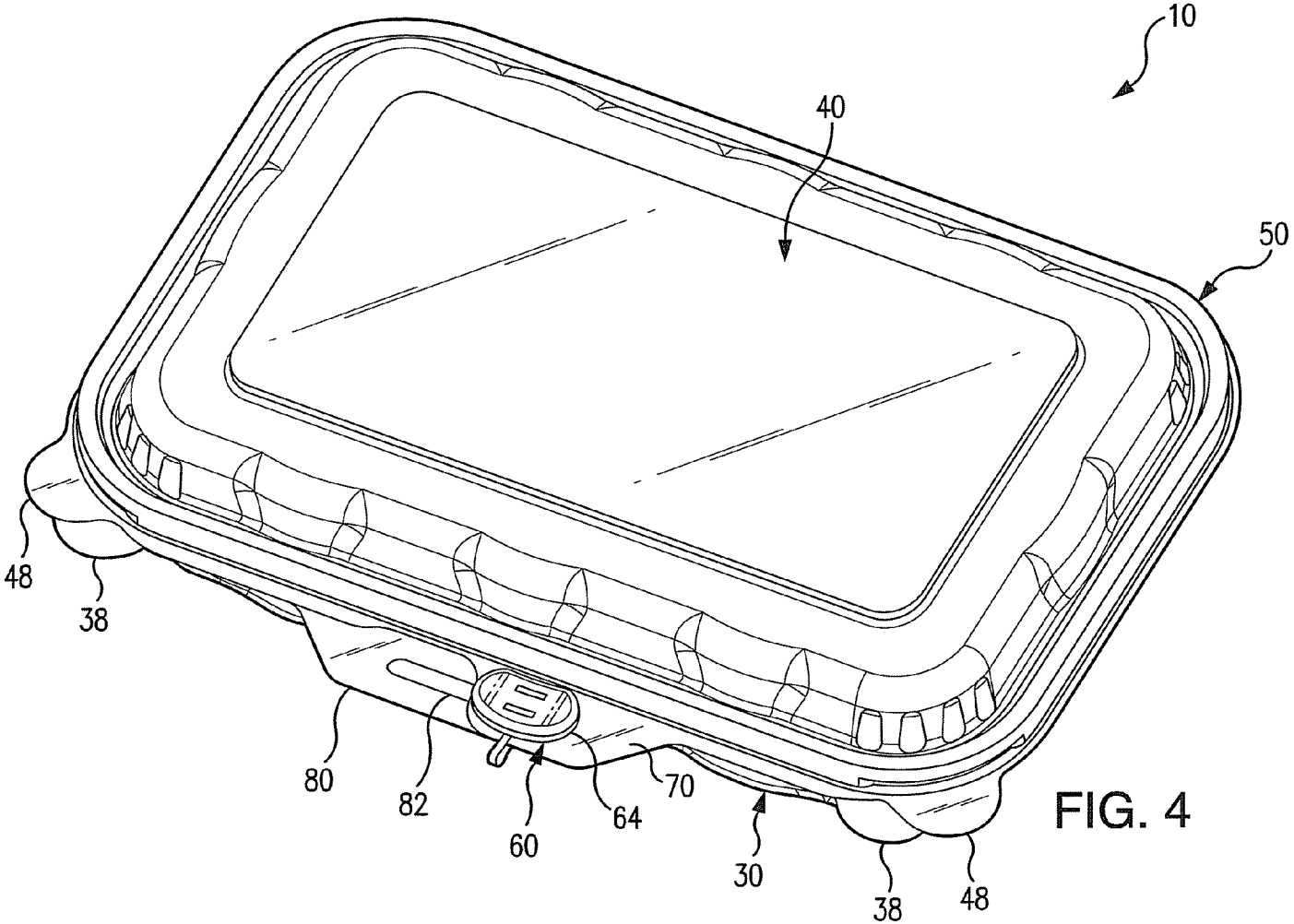
FIG. 4 is a perspective view of the tamper-resistant/evident container of FIG. 1 wherein a frangible section or tear strip has been removed from the flange of the cover portion and the slider mechanism is located in a first position and maintains the cover portion of the container body in a closed position.
Figure 5:
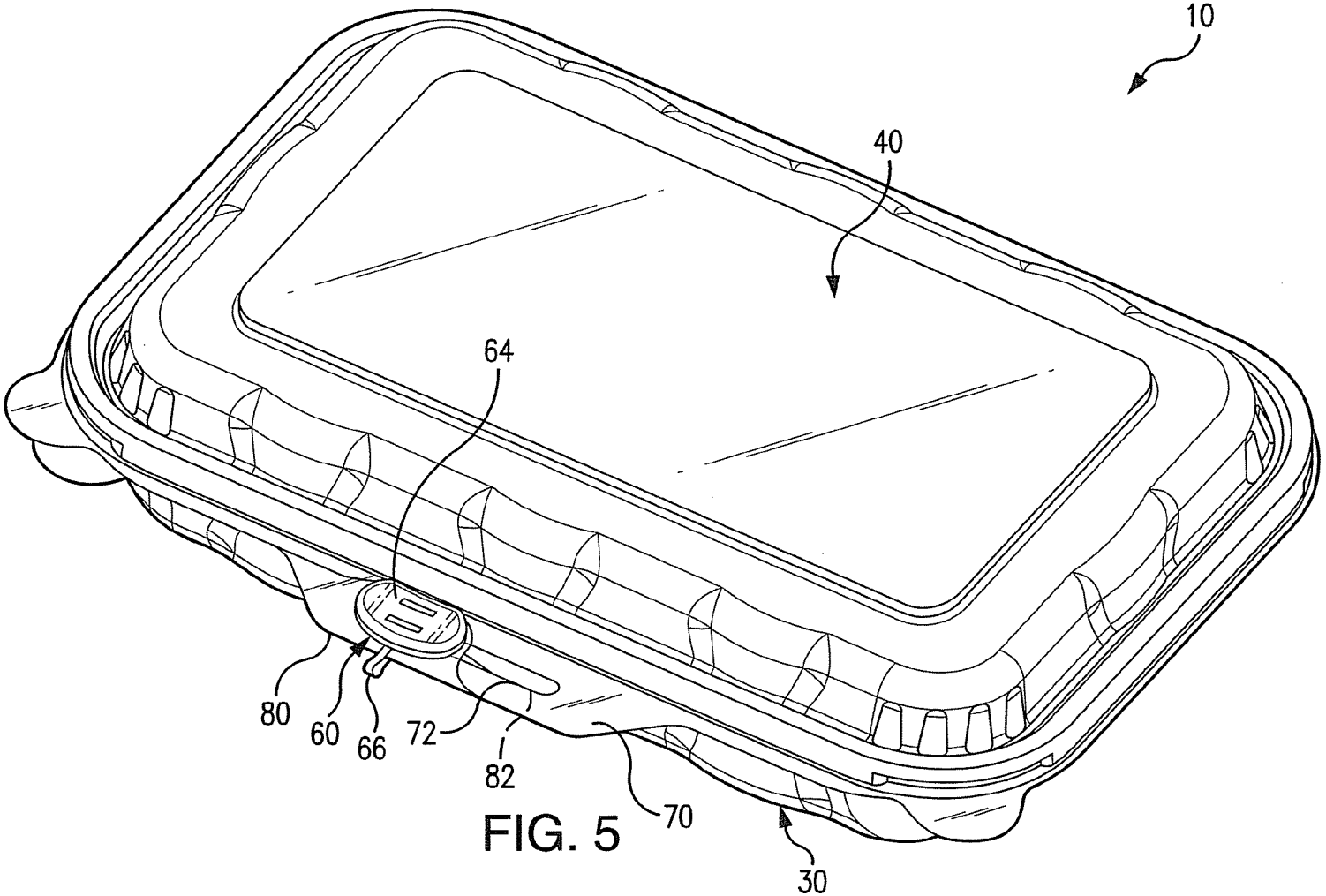
FIG. 5 is a perspective view of the tamper-resistant/evident container of FIG. 1 wherein the slider mechanism has been moved to a second position.
Figure 6:
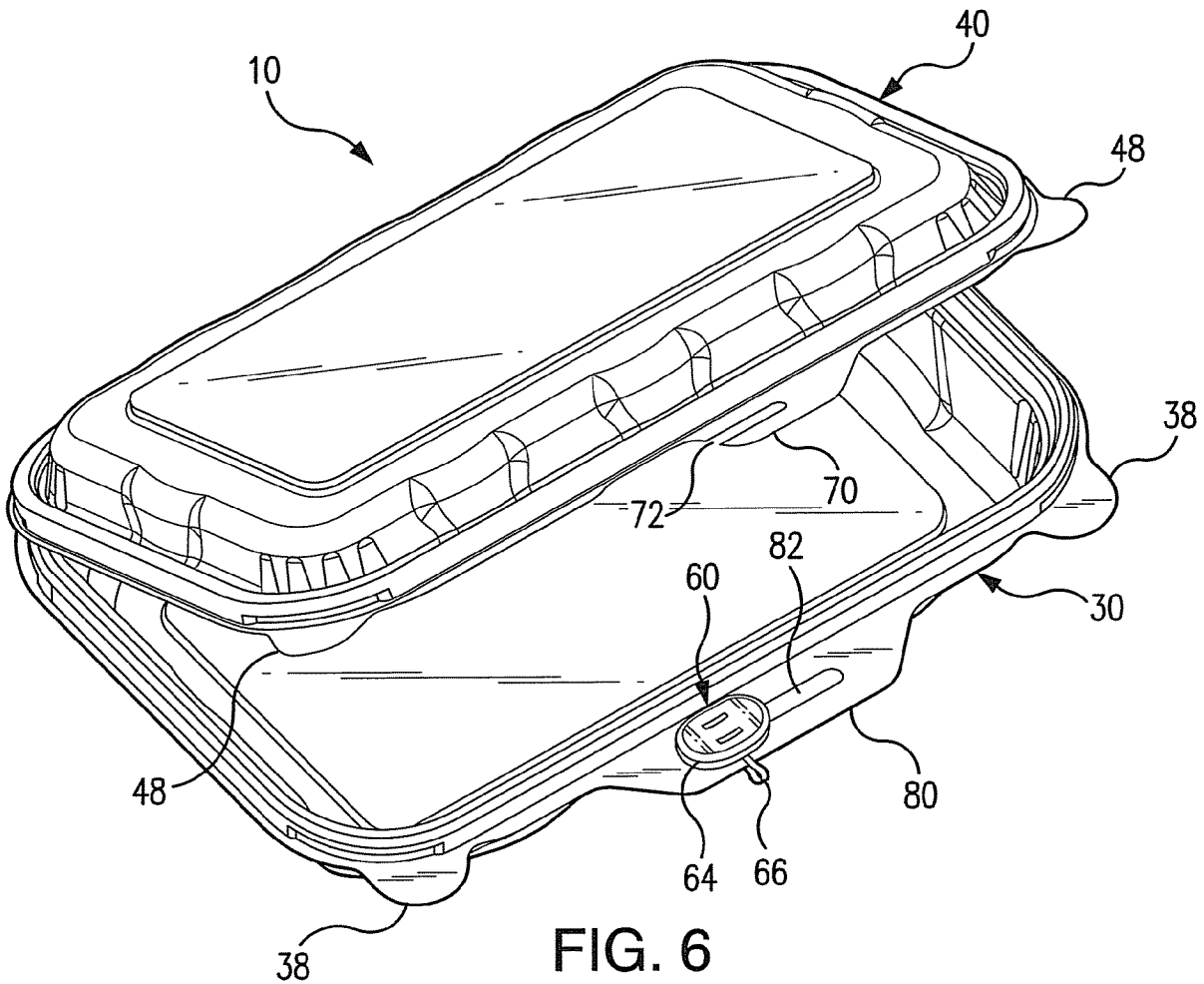
FIG. 6 is a perspective view of the tamper-resistant/evident container of FIG. 1 wherein the cover portion of the container body is shown in the open position.

FIG. 4 illustrates the container 10 after the frangible strip has been removed. As can be seen, removal of the frangible strip exposes the slot 82 formed in the lower flange extension 80 and allows the slide mechanism 60 to travel to a second position (see FIG. 5) thereby enabling the cover portion 40 to be moved to the open position (see FIG. 6). Those skilled in the art will readily appreciate that more than one slide mechanism, with or without corresponding tamper-evidence features (e.g., a tear strip), can be used to secure the container in the closed position. More specifically, the container may include a tamper-evident mechanism or feature for each slide mechanism. For example, in alternative constructions, the container body can be furnished as a two-piece construction; and the hinge section can be replaced by a second set of flange extensions and another slider mechanism.

As shown in FIGS. 1-6, the cover portion 40 and the base portion 30 of container 10 have a generally rectangular configuration. However, those skilled in the art will readily appreciate that the inventive aspects of the present invention are not limited to rectangular containers and can be applied to containers of various shapes.

Figure 7:
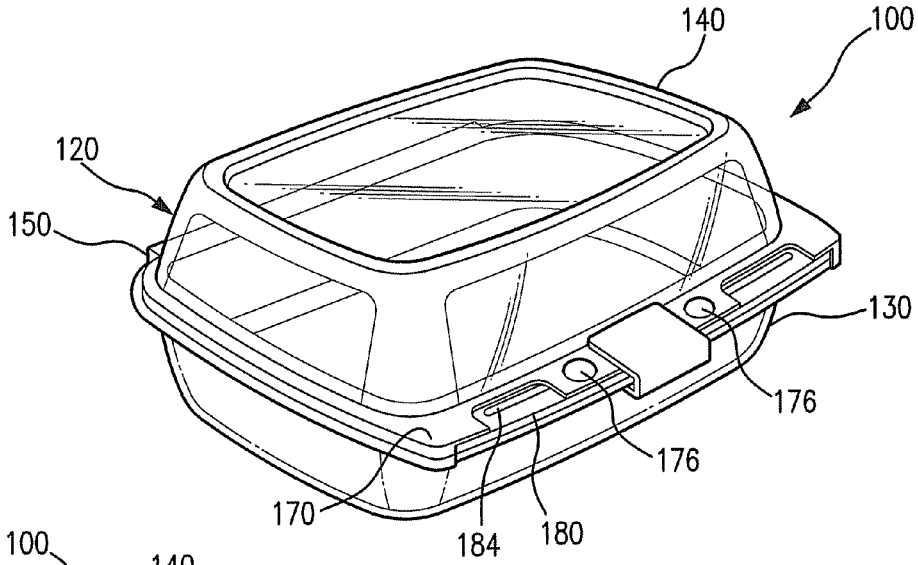
FIG. 7 is a perspective view of an alternative embodiment of a tamper-resistant/evident container constructed in accordance with the present invention.
Figure 8A:
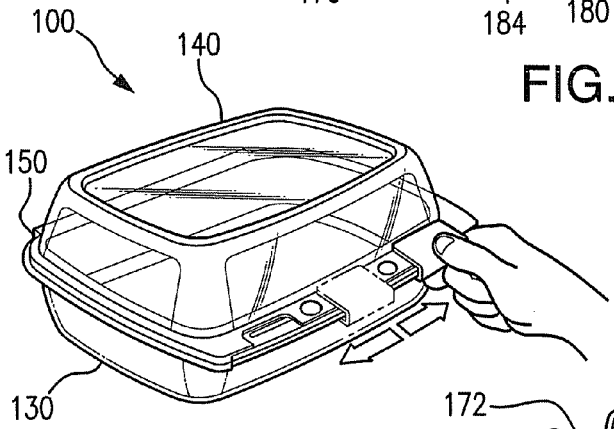
FIGS. 8A and 8B illustrate the container shown in FIG. 7 in the closed position (FIG. 8A), wherein the slide mechanism is centrally positioned on the peripheral flange of the cover, and in the open position, wherein the slider mechanism has been moved to the right allowing the cover to be moved to the open position.
Figure 8B:
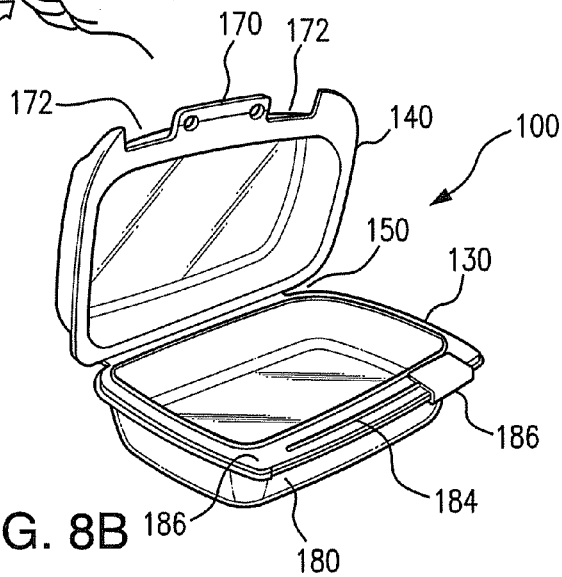

Referring now to FIGS. 7, 8A and 8B which illustrate a further tamper-evident container of the present invention which has been designated as reference numeral 100. Like container 10, container 100 includes a container body 120 formed by a base portion 130 that is joined to a cover portion 140 through a hinge section 150.

The cover portion 140 provides an upper flange extension 170 that defines two cutouts 172 (see FIG. 8B). The base portion 130 provides a lower flange extension 180. The hinge section 150 allows the cover portion 140 to move between an open position (see FIG. 8B) wherein the cover portion 140 is spaced apart from the base portion 130 to a closed position (see FIGS. 7 and 8A) wherein the cover portion 140 is approximated with the base portion 130 and forms a product storage compartment.

A U-shaped slide mechanism 160 is mounted the upper and lower flange extension 170/180 and is movable between a first position (FIG. 7) and a second position (FIGS. 8A and 8B). The slide mechanism rides along a rail 184 which is formed in the lower flange extension 180 of the base member 130. In the first position the slide mechanism 160 is engaged with the upper and lower flange extensions 170/180 and secures the cover portion 140 in the closed position. In the second position, the slide mechanism 160 is aligned with one of the cutouts 172 formed in the upper flange thereby enabling the cover 140 to be moved to the open position.

The container 100 further includes a tamper-evidence mechanism for indicating whether the slide mechanism 160 has been previously moved from the first position to the second position. As shown in FIG. 7, the tamper-evidence mechanism for indicating whether the slide mechanism has been previously moved from the first position to the second position includes two molded protuberances 176 formed in the upper flange extension 170 of the cover portion 140. If the slide mechanism 160 is moved from the first position to the second position, one of the molded protuberances will be crush so as to indicate the prior opening of container 100.

FIG. 8A illustrates that the slide mechanism 160 can be moved either to the left or right of the container centerline to a second position. As shown in FIG. 8B, protuberances can also be formed on the lower flange extension 180 so as to stiffen the tamper-evident feature and make it more difficult for the slide mechanism 160 to transition from the first position to the second position.

Figure 9:
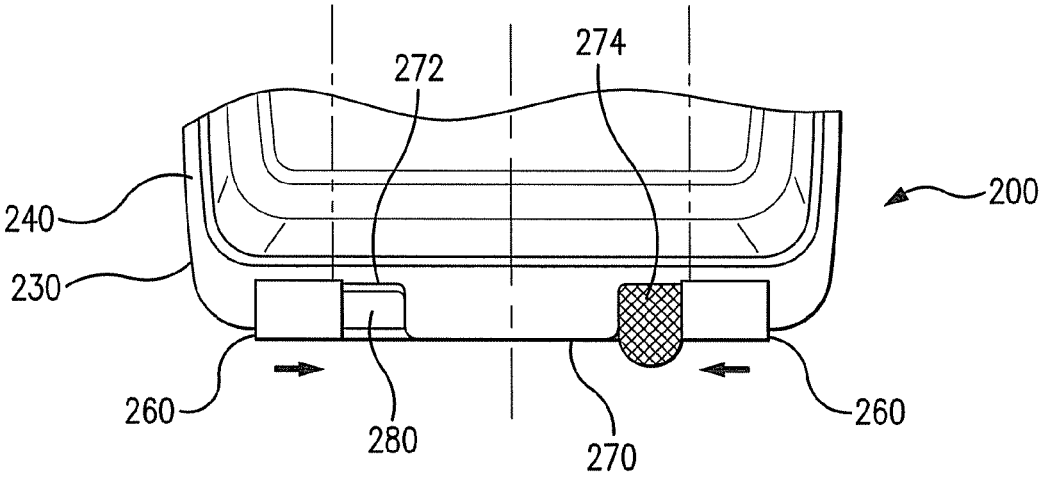
FIG. 9 is a top plan view illustrating a third embodiment of the tamper-resistant/evident container of the present invention which include two slider mechanism for securing the container in the closed position.

FIG. 9 provides a top plan view of a portion of a further embodiment of a tamper-evident container which has been constructed in accordance with the present invention and designated as reference number 200. Like container 100, container 200 includes a container body 220 formed by a base portion 230 that is joined to a cover portion 240 through a hinge section (not shown). Container 200 also includes two U-shaped slider mechanisms 260 which secure the cover portion 240 in the closed position by holding an upper flange extension 270 associated with the cover portion 240 in mating engagement with a lower flange extension 260 associated with the base portion 230. The lower flange extension 280 of the base member 230 has two guide rails upon which the slide mechanism 260 ride.

The upper flange extension includes two frangible sections 274 (right shown) which when removed create two slots 272 (left shown) positioned on opposite sides of the container centerline "C". Container 200 can only be opened by removing both frangible sections 274 and by aligning the slide mechanisms 260 with the slots 272.

Those skilled in the art will readily appreciate that container 200 can be provided with only a single slide mechanism or with more than two slide mechanisms without departing from the inventive aspects of the present disclosure.

In certain constructions, the containers are made from a polymeric material. It is envisioned that the polymeric material can be chosen from the group consisting of polyethylene, polypropylene, polyvinyl chloride, polyethylene terephtalate and combinations thereof. However other currently existing or newly created polymers or synthetic materials can be used, such as polylactic acid based polymers which include impact modifiers.

The frangible strips can be formed using any known technique or forming process, such as for example, micro perforations.

It should be readily understood that a container constructed in accordance with the present invention, which is preferably a plastic container used for carrying edible items, can be manufactured in a variety of shapes and sizes. The forming process can also vary to include methods such as thermoforming, injection molding or blow molding. The container can be transparent or translucent, and may be colored in either instance. Also, vents can be provided in the container to promote airflow therethrough, if appropriate based on the intended contents of the container.

Although exemplary and preferred aspects and embodiments of the present invention and forming methods have been described with a full set of features, it is to be understood that the disclosed container and method of manufacture may be practiced successfully without the incorporation of each of those features. Thus, it is to be understood that modifications and variations may be utilized without departure from the spirit and scope of the invention and method disclosed herein, as those skilled in the art will readily understand. Such modifications and variations are considered to be within the purview and scope of the appended claims and their equivalents.

What is claimed is:

1. A product storage container comprising:

a) a container body which includes a base portion that is joined to a cover portion through a hinge section, the cover portion providing an upper flange extension that defines a first slot, the base portion providing a lower flange extension that defines a second slot; and the hinge section allowing the cover portion to move between an open position wherein the cover portion is spaced apart from the base portion to a closed position wherein the cover portion is approximated with the base portion and forms a product storage compartment;

b) a slide mechanism positioned within the first and second slots and configured to secure the cover portion in the closed position when the slide mechanism is arranged in a first position; and c) a frangible tear strip associated with one of the upper or the lower flange extensions, which maintains the slide mechanism in the first position and upon severing allows the slide mechanism to travel to a second position thereby enabling the cover to be moved to the open position.

2. A product storage container as recited in claim 1, wherein the cover portion and the base portion are adapted and configured to sealingly engage about their periphery.

3. A product storage container as recited in claim 1, wherein the hinge section is adapted and configured to bias the container in the open position such that when the slide mechanism is moved to the second position the container springs open.

4. A product storage container as recited in claim 1, wherein the second slot defined in the lower flange section is longer than the first slot defined in the upper flange section and the frangible tear strip is associated with the upper flange section.

5. A product storage container as recited in claim 1, wherein the cover portion and the base portion have a generally rectangular configuration.

6. A product storage container as recited in claim 1, wherein the slide mechanism includes a lower body portion, an upper body portion, a lanyard extending between the upper and lower body portions and means for securing the slide mechanism in an assembled configuration.

7. A product storage container as recited in claim 6, wherein the means for securing the slide mechanism in an assembled configuration includes at least one prong member associated with the lower body portion of the slide mechanism and a keeper element associated with the upper body portion of the slide mechanism.

8. A product storage container comprising:

a) a container body which includes a base portion and a cover portion, the cover portion providing an upper flange extension that defines a first elongated slot, the base portion providing a lower flange extension that defines a second elongated slot; wherein the first and second elongated slots are aligned when the cover portion is in a closed position and approximate the base portion so as to form a product storage compartment;

b) a slide mechanism positioned within the first and second slots and configured to secure the cover portion in the closed position when the slide mechanism is arranged in a first position; and c) a frangible tear strip associated with one of the upper or the lower flange extensions, which maintains the slide mechanism in the first position and upon severing allows the slide mechanism to travel to a second position thereby enabling the cover to be moved to the open position.

9. A product storage container as recited in claim 8, wherein the cover portion and the base portion are adapted and configured to sealingly engage about their periphery.

10. A product storage container as recited in claim 8, wherein the second slot defined in the lower flange section is longer than the first slot defined in the upper flange section and the frangible tear strip is associated with the upper flange section.

11. A product storage container as recited in claim 8, further comprising a hinge section joining the cover portion to the base portion, the hinge section allowing the cover portion to move between an open position wherein the cover portion is spaced apart from the base portion to the closed position.

12. A product storage container as recited in claim 11, wherein the hinge section is adapted and configured to bias the container in the open position such that when the slide mechanism is moved to the second position the container springs open.

13. A product storage container as recited in claim 8, wherein the slide mechanism includes a lower body portion, an upper body portion, a lanyard extending between the upper and lower body portions and means for securing the slide mechanism in an assembled configuration.

14. A product storage container as recited in claim 13, wherein the means for securing the slide mechanism in an assembled configuration includes at least one prong member associated with the lower body portion of the slide mechanism and a keeper element associated with the upper body portion of the slide mechanism.

15. A tamper-evident/resistant product storage container comprising:

a) a container body which includes a base portion that is joined to a cover portion through a hinge section, the cover portion providing an upper peripheral flange extension that defines at least one cutout, the base portion providing a lower peripheral flange extension; and the hinge section allowing the cover portion to move between an open position wherein the cover portion is spaced apart from the base portion to a closed position wherein the cover portion is approximated with the base portion and forms a product storage compartment;

b) at least one slide mechanism movable between a first position and a second position, in the first position the slide mechanism is engaged with the upper and lower flange extensions and secures the cover portion in the closed position and in the second position the slide mechanism is aligned with the cutout in the upper flange thereby enabling the cover to be moved to the open position; and c) means for indicating whether the slide mechanism has been previously moved from the first position to the second position.

16. A product storage container as recited in claim 15, wherein the means for indicating whether the slide mechanism has been previously moved from the first position to the second position includes at least one molded protuberance formed in the upper flange extension of the cover portion.

17. A product storage container as recited in claim 15, wherein the means for indicating whether the slide mechanism has been previously moved from the first position to the second position includes two molded protuberance formed in the upper flange extension of the cover portion.

18. A tamper-evident/resistant product storage container comprising:

a) a container body which includes a base portion that is joined to a cover portion through a hinge section, the cover portion providing an upper peripheral flange extension that includes at least one frangible section that upon removal exposes a cutout, the base portion providing a lower peripheral flange extension, and the hinge section allowing the cover portion to move between an open position wherein the cover portion is spaced apart from the base portion to a closed position wherein the cover portion is approximated with the base portion and the cover and base portions together define a product storage compartment; and b) at least one slide mechanism movable between a first position and a second position, wherein in the first position the slide mechanism is engaged with the upper and lower flange extensions and secures the cover portion in the closed position, and in the second position, the slide mechanism is aligned with the cutout in the upper flange, thereby enabling the cover to be moved to the open position.

19. A tamper-evident/resistant product storage container as recited in claim 18, further comprising means for indicating whether the at least one slide mechanism has been previously moved from the first position to the second position.

20. A product storage container as recited in claim 19, wherein the means for indicating whether the slide mechanism has been previously moved from the first position to the second position includes at least one molded protuberance formed in the upper flange extension of the cover portion.

* * * * *